US012453389B2

(12) United States Patent
Fukuyama

(10) Patent No.: US 12,453,389 B2
(45) Date of Patent: Oct. 28, 2025

(54) HELMET

(71) Applicant: SHOEI Co., Ltd., Tokyo (JP)

(72) Inventor: Banri Fukuyama, Tokyo (JP)

(73) Assignee: SHOEI Co., Ltd., Tokyo (JP)

( * ) Notice: Subject to any disclaimer, the term of this patent is extended or adjusted under 35 U.S.C. 154(b) by 0 days.

(21) Appl. No.: 18/844,014

(22) PCT Filed: Jan. 24, 2023

(86) PCT No.: PCT/JP2023/002064
§ 371 (c)(1),
(2) Date: Sep. 4, 2024

(87) PCT Pub. No.: WO2023/171160
PCT Pub. Date: Sep. 14, 2023

(65) Prior Publication Data

US 2025/0185750 A1 Jun. 12, 2025

(30) Foreign Application Priority Data

Mar. 7, 2022 (JP) ..... 2022-034207

(51) Int. Cl.
*A42B 3/32* (2006.01)
*A42B 3/22* (2006.01)

(52) U.S. Cl.
CPC ..... *A42B 3/326* (2013.01); *A42B 3/221* (2013.01); *A42B 3/222* (2013.01)

(58) Field of Classification Search
CPC ..... A42B 3/326; A42B 3/221; A42B 3/222
See application file for complete search history.

(56) References Cited

U.S. PATENT DOCUMENTS 5,084,918 A * 2/1992 Breining ..... A42B 3/326 2/424
6,226,803 B1 * 5/2001 Tanaka ..... A42B 3/326 2/424

(Continued)

FOREIGN PATENT DOCUMENTS

EP 0 223 139 A1 5/1987
JP 04-1277223 U 11/1992

(Continued)

OTHER PUBLICATIONS

International Search Report and Written Opinion dated Mar. 14, 2023, in connection with International Application No. PCT/JP2023/002064, with English translation thereof.

(Continued)

*Primary Examiner* — Khaled Annis
(74) *Attorney, Agent, or Firm* — Wolf, Greenfield & Sacks, P.C.

(57) ABSTRACT

A helmet includes a helmet body having a front opening, a closing member attached to the outer side of the helmet body so as to close the opening, and an exterior member attached. The helmet body includes a first outer surface, a first attachment surface to which the closing member is attached, and a second attachment surface which is located between the first outer surface and the first attachment surface and to which the exterior member is attached. The exterior member includes a second outer surface continued to the curved surface shape of the first outer surface, and a side surface. The second outer surface and the side surface form a first angle toward inside of the helmet body. The first outer surface and the second attachment surface form a second angle toward inside of the helmet body. The second angle is larger than the first angle.

7 Claims, 4 Drawing Sheets

(56) References Cited

U.S. PATENT DOCUMENTS

| | | | | |
|---|---|---|---|---|
| 11,278,078 | B2 * | 3/2022 | Fiorino | A42B 3/222 |
| 2003/0182716 | A1 * | 10/2003 | Wu | A42B 3/326 2/424 |
| 2003/0229934 | A1 * | 12/2003 | Gafforio | A42B 3/222 2/424 |
| 2012/0066818 | A1 * | 3/2012 | Pierini | A42B 3/326 2/424 |
| 2014/0033406 | A1 * | 2/2014 | Lebel | A42B 3/326 2/422 |
| 2020/0178639 | A1 * | 6/2020 | Jwa | A42B 3/205 |
| 2022/0408868 | A1 * | 12/2022 | Isobe | A42B 3/223 |

FOREIGN PATENT DOCUMENTS

| | | | |
|---|---|---|---|
| JP | 2000-096334 | A | 4/2020 |
| JP | 2021-116502 | A | 8/2021 |

OTHER PUBLICATIONS

Japanese Notice of Reasons for Refusal issued Mar. 26, 2024, in connection with Japanese Application No. 2022-034207, with English translation thereof.

* cited by examiner

HELMET

CROSS REFERENCE TO RELATED APPLICATIONS

This Application is a national stage filing under 35 U.S.C. 371 of International Patent Application Serial No PCT/JP2023/002064, filed Jan. 24, 2023, which claims priority to Japanese application number 2022-034207, filed Mar. 7, 2022. The entire contents of these applications are incorporated herein by reference in their entirety.

TECHNICAL FIELD

The present disclosure relates to a helmet.

BACKGROUND ART

A motorcycle helmet includes a hemispherical helmet body and a shield attached to the helmet body. The helmet body includes a front opening for providing a wearer with a field of view. The shield is an example of a closing member that closes the opening of the helmet body. Patent Literature 1 describes a full-face helmet including a helmet body and a shield. Further, a flip-up helmet includes, in addition to a shield, a chin guard which serves as a closing member and is pivotable upward with respect to the helmet body. The outer surface of the helmet body includes a hemispherical curved surface and attachment surfaces to which the closing members are attached. Each attachment surface is recessed from the curved surface toward the inner side of the helmet body to reduce the difference in height between the outer surface of the closing member and the curved surface.

CITATION LIST

Patent Literature

Patent Literature 1: Japanese Laid-Open Patent Publication No. 2021-116502

SUMMARY OF INVENTION

Technical Problem

The boundary between the attachment surface and the curved surface has an inclined surface that rises steeply from the attachment surface toward the curved surface in conformance with the end surface of the closing member. Such an inclined surface is formed in the helmet so that the outer surface of the closing member appears to be continuous with the curved surface. However, the inclined surface forms a steep step on the helmet body. It is desirable that the outer surface of the helmet body be shaped smoothly to disperse external force in a preferred manner.

Solution to Problem

In one general aspect of the present disclosure, a helmet includes a helmet body including a front opening, a closing member attached to an outer side of the helmet body to close the opening, and an exterior member attached to the outer side of the helmet body adjacent to the closing member. The helmet body includes a first outer surface having a curved shape, a first attachment surface to which the closing member is attached, and a second attachment surface, located between the first outer surface and the first attachment surface, to which the exterior member is attached. The exterior member includes a second outer surface having a curved shape continuous with the first outer surface having the curved shape, and a side surface extending from one end of the second outer surface toward the helmet body. The second outer surface and the side surface are formed at a first angle at a side located toward an inner side of the helmet body. The first outer surface and the second attachment surface are formed at a second angle where a boundary of the first outer surface and the second attachment surface extends at a side located toward the inner side of the helmet body. The second angle is greater than the first angle.

DESCRIPTION OF EMBODIMENTS

A helmet according to one embodiment will now be described with reference to FIGS. 1 to 6. In FIGS. 1 to 6, the frame of reference for the forward, rearward, leftward, rightward, upward, and downward directions will be based on directions as viewed from a wearer of the helmet.

Helmet

Figure 1:
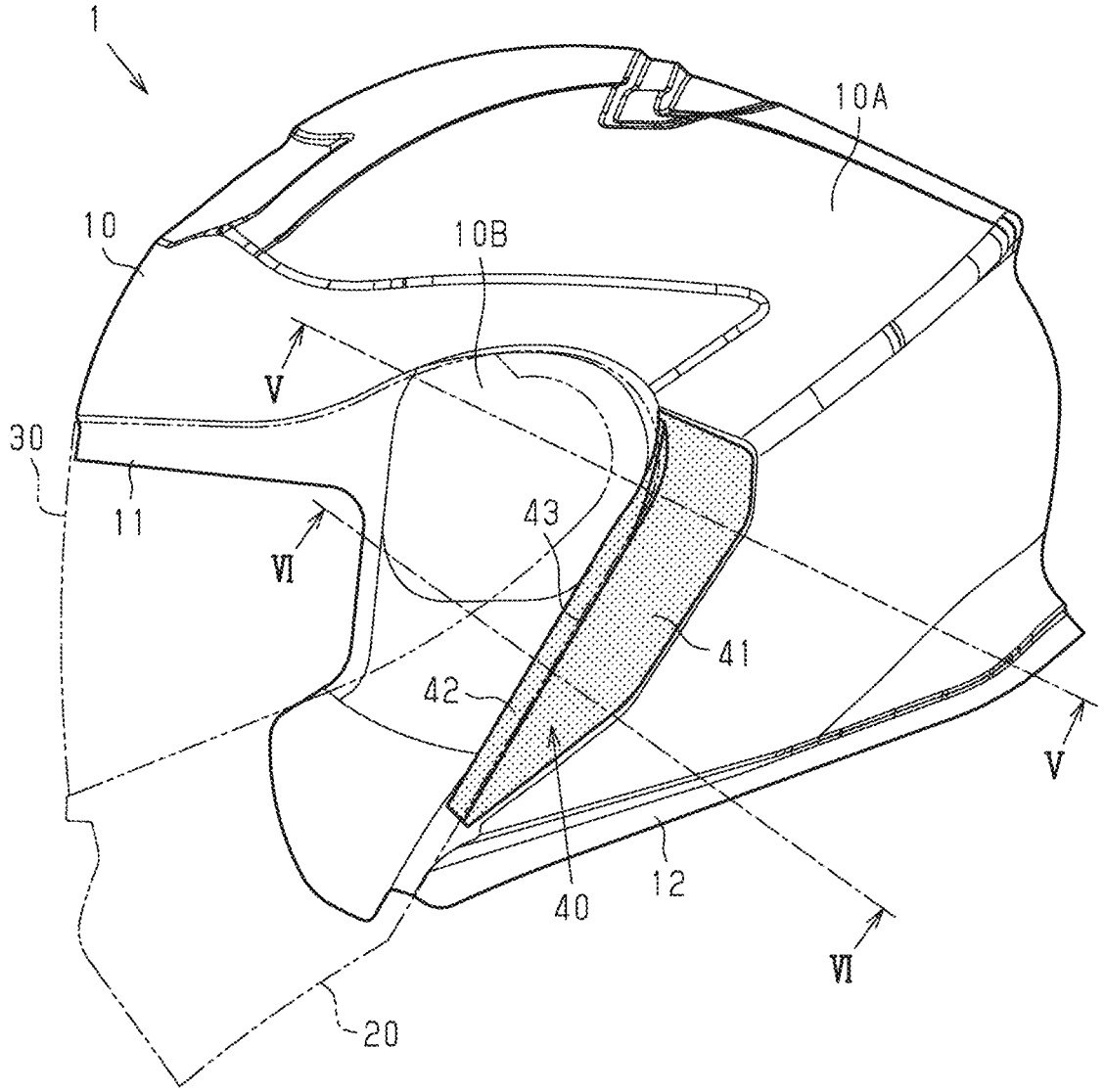
FIG. 1 is a side view of a helmet.

As shown in FIG. 1, a helmet 1 of the present embodiment is, for example, a flip-up helmet. The helmet 1 includes a helmet body 10, a chin guard 20, a shield 30, and right and left exterior members 40. In FIG. 1, the exterior member 40 is shaded. The helmet 1 may accommodate, at the inner side of the helmet body 10, a liner, which is an impact absorber made of resin foam, and a cushioning interior pad, which enhances contact with the head of the wearer.

The helmet body 10 forms the shell of the helmet 1. The helmet body 10 is a hemispherical plastic member. The helmet body 10 is made of a material selected from, for example, acrylonitrile-butadiene-styrene copolymer (ABS), polycarbonate (PC), fiber-reinforced plastic (FRP), and the like. In the present embodiment, the helmet body 10 is made of FRP for impact resistance.

The helmet body 10 includes a front opening 11. The opening 11 is open frontward to provide the wearer with a field of view. The lower portion of the opening 11 is closed by the chin guard 20. The upper portion of the opening 11 is closed by the shield 30. The helmet body 10 includes a bottom opening 12 that is open downward. The head of the wearer is fitted through the bottom opening 12. The opening 11 is connected to the bottom opening 12 at the front lower side of the helmet body 10.

The helmet body 10 includes a first outer surface 10A and right and left first attachment surfaces 10B. The first outer surface 10A is a surface of the helmet body 10 that is exposed to the outside and has a hemispherical curved shape. The two first attachment surfaces 10B are arranged in correspondence with the two temples of the wearer. The two first attachment surfaces 10B are located at the right end and the left end of the opening 11. The ends of the chin guard 20 and the shield 30 are attached to the first attachment surfaces 10B.

The chin guard 20 and the shield 30 are examples of a closing member that closes the opening 11. The chin guard 20 and the shield 30 are members separate from the helmet body 10. The chin guard 20 has a right end and a left end attached to the corresponding one of the two first attachment surfaces 10B of the helmet body 10. The shield 30 has a right end and a left end attached to the corresponding one of the two first attachment surfaces 10B of the helmet body 10. The chin guard 20 is made of, for example, the same type of material as the helmet body 10. The shield 30 is a plate-shaped member that is light-transmissive. The shield 30 prevents flying foreign matter, rain, wind, and the like from entering the front of the helmet 1 and improves the visibility of the wearer.

The chin guard 20 includes two first attached regions at the left and right ends. The two first attached regions of the chin guard 20 are attached to the two first attachment surfaces 10B so that the chin guard 20 is pivotable upward with respect to the helmet body 10. The shield 30 includes two second attached regions at the left and right ends. The two second attached regions of the shield 30 are attached to the two first attachment surfaces 10B so that the shield 30 is pivotable upward with respect to the helmet body 10.

When the opening 11 is closed, the chin guard 20 is pivoted upward with respect to the helmet body 10 about an axis extending between the two first attached regions, which are attached to the two first attachment surfaces 10B. In a similar manner, when the opening 11 is closed, the shield 30 is pivoted upward with respect to the helmet body 10 about the axis extending between the two second attached regions, which are attached to the two first attachment surfaces 10B. The chin guard 20 and the shield 30 are pivoted upward to open the opening 11. This allows the head of the wearer to be easily fitted into the helmet body 10.

Each of the two exterior members 40 is attached to the outer side of the helmet body 10 rearward from the chin guard 20, in particular, to a position located at the rear side of the corresponding first attached region adjacent to the chin guard 20. The exterior member 40 is made of a material such as modified polyphenylene ether (m-PPE), polyphenylene oxide (PPO), acrylonitrile-butadiene-styrene copolymer (ABS), polycarbonate (PC), polycarbonate-acrylonitrile-butadiene-styrene copolymer (PC-ABS), or the like. In the present embodiment, the exterior member 40 is made of, for example, modified polyphenylene ether for its moldability and colorability.

Each exterior member 40 includes a second outer surface 41 and a side surface 42. The second outer surface 41 has a curved shape that is continuous with the curved shape of the first outer surface 10A. The second outer surface 41 is arranged between the first outer surface 10A and the outer surface of the chin guard 20. The side surface 42 extends from one end of the second outer surface 41 toward the helmet body 10. The boundary between the first outer surface 10A and a second attachment surface 10C, the second outer surface 41, and the side surface 42 are arranged next to one another in this order. The side surface 42 faces the end surface of the chin guard 20.

FIG. 1 shows an example of a structure in which the chin guard 20 includes a part located between the left end of the shield 30 and the left-side exterior member 40 and a part located between the right end of the shield 30 and the right-side exterior member 40. Instead, the upper portion of the exterior member 40 may be adjacent to the shield 30, and the lower portion of the exterior member 40 may be adjacent to the chin guard 20. In this case, the upper portion of the second outer surface 41 is arranged between the first outer surface 10A and the outer surface of the shield 30. Further, the lower portion of the second outer surface 41 is arranged between the first outer surface 10A and the outer surface of the chin guard 20.

Helmet Body

Figure 2:
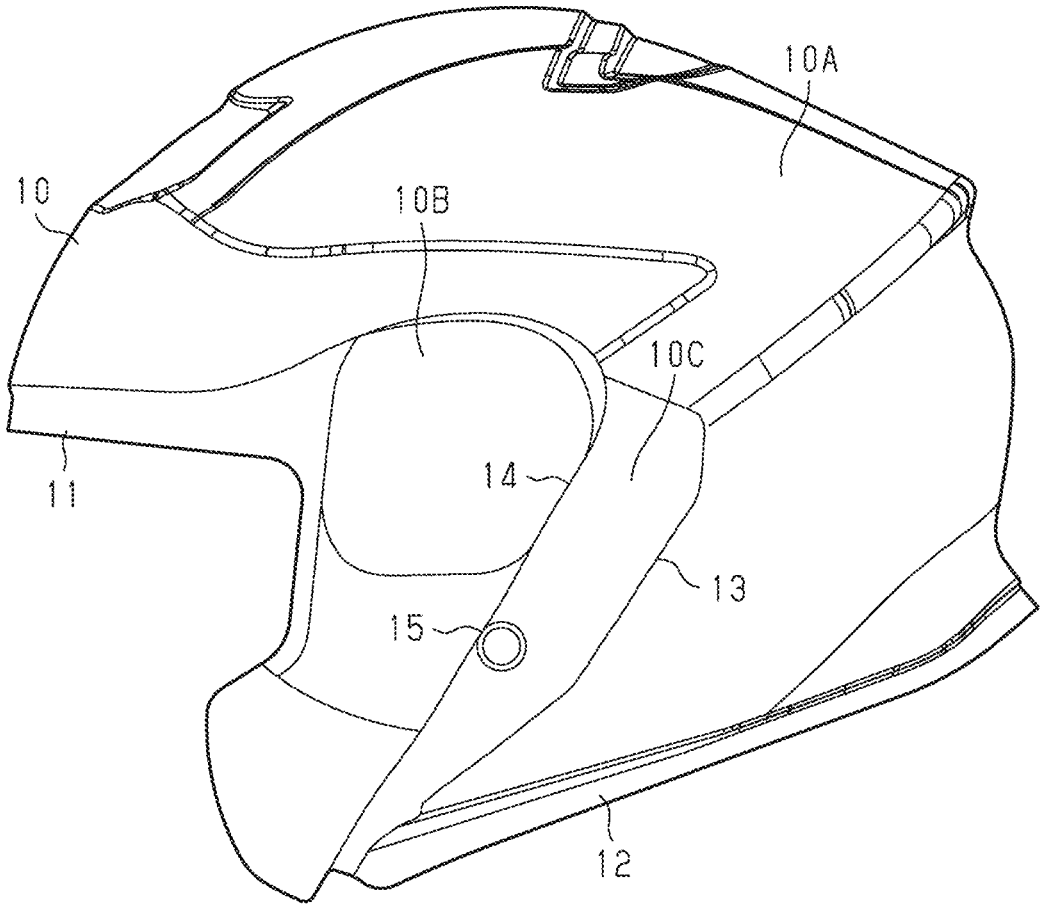
FIG. 2 is a side view of a helmet body.

As shown in FIG. 2, the outer surface of the helmet body 10 further includes right and left second attachment surfaces 10C in addition to the first outer surface 10A and the two first attachment surfaces 10B described above. The two second attachment surfaces 10C are arranged in correspondence with the two temples of the wearer. The two second attachment surfaces 10C are each located rearward from the corresponding first attachment surface 10B. Each second attachment surface 10C is located between the first attachment surface 10B and the first outer surface 10A. The two exterior members 40 are attached to the two second attachment surfaces 10C. The exterior members 40 are attached to the helmet body 10 by means of, for example, heat welding, adhesive, bonding tape, screws, or the like.

In the helmet body 10, the first attachment surface 10B is recessed from the first outer surface 10A toward the inner side of the helmet body 10. The second attachment surface 10C is an inclined surface that smoothly connects the first attachment surface 10B to the first outer surface 10A.

The helmet body 10 includes a first boundary 13 and a second boundary 14. The first boundary 13 is the boundary between the first outer surface 10A and the second attachment surface 10C. The first boundary 13 is, for example, a ridge projecting toward the outer side of the helmet body 10. The second boundary 14 is the boundary between the first attachment surface 10B and the second attachment surface 10C. The second boundary 14 is, for example, a valley recessed toward the inner side of the helmet body 10. The second attachment surface 10C is defined by the first boundary 13 and the second boundary 14.

The lateral dimension of the first outer surface 10A of the helmet body 10 gradually increases from a position that covers the top of the head of the wearer toward the lower side. The lateral dimension of the first outer surface 10A of the helmet body 10 is maximal at a position corresponding to the temples of the wearer, in particular, at a point on the first boundary 13, and decreases from the position covering the temples toward the bottom opening 12.

The second attachment surface 10C may include a fixing recess 15. The fixing recess 15 is a portion in the second attachment surface 10C that is recessed toward the inner side of the helmet body 10. A fixing member such as a rivet used to fix a member accommodated inside the helmet body 10 to the helmet body 10 is arranged in the fixing recess 15.

Exterior Member

Figure 3:
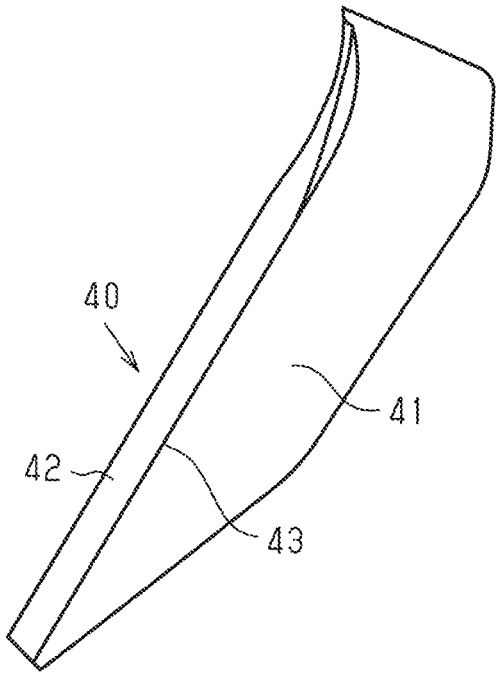
FIG. 3 is a front view of an exterior member.
Figure 4:
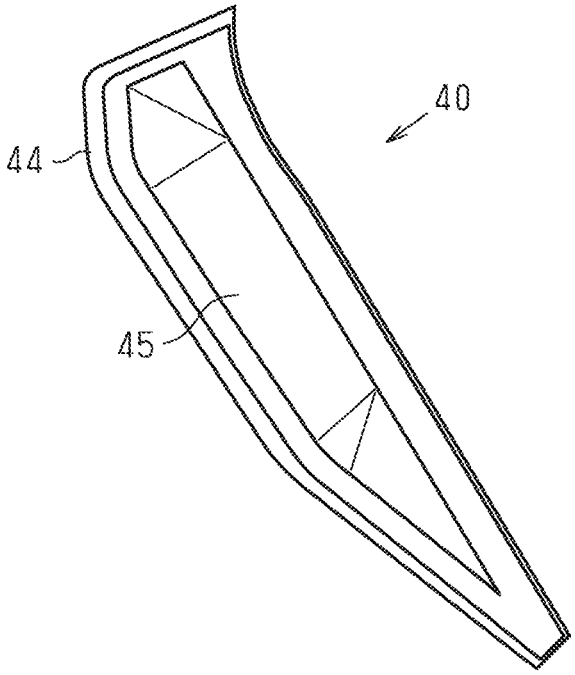
FIG. 4 is a rear view of the exterior member.

The exterior members 40 will now be described with reference to FIGS. 3 and 4. The two exterior members 40 are shaped to be plane-symmetrical relative to an imaginary plane (not shown) located in the middle of the helmet body 10 in the lateral direction. FIGS. 3 and 4 show only the one of the two exterior members 40 located at the left side of the helmet body 10.

As shown in FIG. 3, each exterior member 40 includes, in addition to the second outer surface 41 and the side surface 42, a ridgeline 43 which is a ridge projecting toward the outer side of the helmet body 10. The ridgeline 43 is the boundary between the second outer surface 41 and the side surface 42.

As shown in FIG. 4, each exterior member 40 includes an attached surface 44. The attached surface 44 connects the edge of the second outer surface 41 located at the side opposite to the ridgeline 43 to the edge of the side surface 42 located at the side opposite to the ridgeline 43. The attached surface 44 faces the second attachment surface 10C when the exterior member 40 is attached to the helmet body 10. The outer edge of the attached surface 44 is shaped in conformance with the outer edge of the second attachment surface 10C, that is, in conformance with the first boundary 13 and the second boundary 14. The central part of the attached surface 44 includes a recess 45. The recess 45 is a portion of the attached surface 44 that is recessed toward the ridgeline 43 and does not contact the second attachment surface 10C.

Cross-Sectional Structure of Helmet Body and Exterior Member

Figure 5:
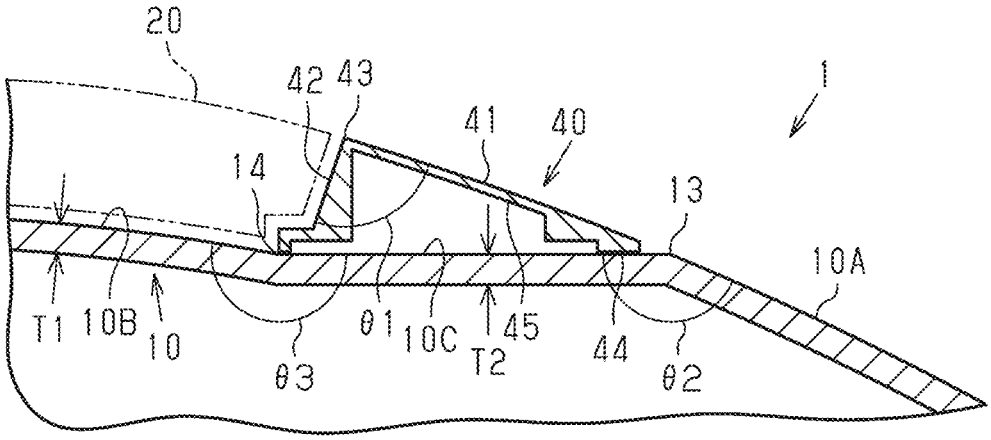
FIG. 5 is a cross-sectional view taken along line V-V in FIG. 1.

As shown in FIG. 5, the second outer surface 41 and the side surface 42 of the exterior member 40 are formed at a first angle θ1 where the ridgeline 43 extends at the side located toward the inner side of the helmet body 10. The first angle θ1 is, for example, in a range of 45 degrees to 150 degrees.

The first outer surface 10A and the second attachment surface 10C of the helmet body 10 are formed at a second angle θ2 where the first boundary 13 extends at the side located toward the inner side of the helmet body 10. The second angle θ2 is greater than the first angle θ1. A comparative example in which the helmet body 10 and the exterior member 40 are integrated will now be discussed. In the comparative example, the helmet body 10 is shaped so that its contour includes the first angle θ1. When the shape of the comparative example is compared with the shape of the helmet body 10 of the present embodiment, the following facts are observed. The contour of the helmet body 10 in the present embodiment is shaped to include the second angle θ2 that is greater than the first angle θ1. Thus, the helmet body 10 of the present embodiment has a more gradual shape than the comparative example and allows external force to be easily dispersed. Specifically, the helmet body 10 of the present embodiment has a smooth shape at the first boundary 13. This improves the impact resistance of the helmet body 10.

The second angle θ2 is closer to 180 degrees than the first angle θ1. The second angle θ2 may be, for example, greater than or equal to 90 degrees and less than 180 degrees. Since the second angle θ2 is in the above range, the first boundary 13 has a smooth shape that allows external force to be more easily dispersed.

The first attachment surface 10B and the second attachment surface 10C of the helmet body 10 are formed at a third angle θ3 where the second boundary 14 extends at the side located toward the inner side of the helmet body 10. The third angle θ3 is greater than the first angle θ1. Since the third angle θ3 is greater than the first angle θ1, the second boundary 14 has a smooth shape that allows external force to be dispersed more easily than the shape of the comparative example.

The third angle θ3 is closer to 180 degrees than the first angle θ1. The third angle θ3 may be, for example, in a range of 90 degrees to 270 degrees. Since the third angle θ3 is in the above range, the second boundary 14 has a smooth shape that allows external force to be more easily dispersed.

The helmet body 10 has thickness T1 in a normal direction at a part defining the first attachment surface 10B. The helmet body 10 has thickness T2 in a normal direction at a part defining the second attachment surface 10C. The thickness T2 may be in a range of 0.8 times to 2 times the thickness T1. By reducing the difference between the thickness T1 and the thickness T2 in the helmet body 10, the shape of the helmet body 10 will facilitate resin molding when filling a mold with a molding material during manufacturing. When the helmet body 10 is made of a fiber-reinforced plastic like in the present embodiment, a fibrous material contained in the molding material can be evenly distributed at the parts of the helmet body 10 corresponding to the first attachment surface 10B and the second attachment surface 10C.

The opening of the recess 45 is closed by the second attachment surface 10C when the exterior member 40 is attached to the helmet body 10. In other words, the helmet 1 includes a hollow portion defined by the second attachment surface 10C and the recess 45.

The recess 45 in the attached surface 44 reduces the weight of the exterior member 40. Further, the recess 45 allows the exterior member 40 to be easily deformed. Thus, an impact applied to the exterior member 40 is not transmitted to the helmet body 10 in a locally concentrated manner.

Figure 6:
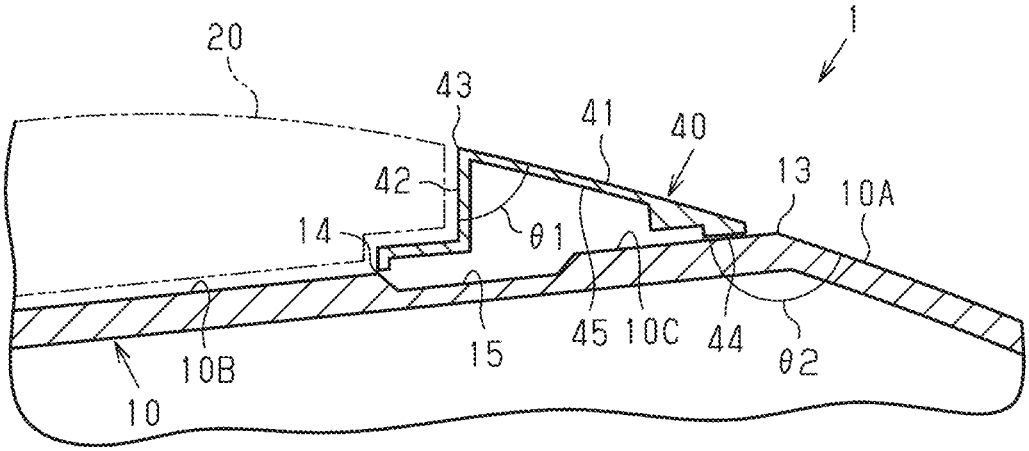
FIG. 6 is a cross-sectional view taken along line VI-VI in FIG. 1.

As shown in FIG. 6, the fixing recess 15 is located in the second attachment surface 10C. This allows the exterior member 40 to cover and hide the fixing member exposed from the helmet body 10. Thus, the aesthetic appeal of the helmet 1 can be improved.

Advantages of Embodiment

The above embodiment has the following advantages.

(1) The second angle θ2 is greater than the first angle θ1. Thus, the first boundary 13 has a smooth shape that disperses external force more easily than the shape of the comparative example in which the helmet body 10 and the exterior member 40 are integrated with each other.

(2) The second angle θ2 is greater than or equal to 90 degrees and less than 180 degrees. Thus, the first boundary 13 has a shape that disperses external force more easily.

(3) The third angle θ3 is greater than the first angle θ1. Thus, the second boundary 14 has a smooth shape that disperses external force more easily than the shape of the comparative example in which the helmet body 10 and the exterior member 40 are integrated with each other.

(4) The third angle θ3 is in the range of 90 degrees to 270 degrees. Thus, the second boundary 14 has a shape that disperses external force more easily.

(5) The difference is reduced between the thickness T1 of the first attachment surface 10B and the thickness T2 of the second attachment surface 10C in the helmet body 10. Thus, the shape of the helmet body 10 facilitates resin molding when filling a mold with a molding material during manufacturing.

(6) The recess 45 of the exterior member 40 reduces the weight of the exterior member 40. Further, the recess 45 allows the exterior member 40 to be easily deformed. This mitigates impacts applied to the exterior member 40 that are transmitted to the helmet body 10.

Modifications

The above-described embodiment may be modified as follows.

The helmet 1 is a flip-up helmet. Instead, the helmet 1 may be, for example, a full-face helmet in which the helmet body 10 and the chin guard 20 are integrated with each other. In this case, the opening 11 is not continuous with the bottom opening 12 at the front lower portion of the helmet body 10. In this case, the shield 30 is the only closing member. Further, the helmet 1 may be an open-face helmet, a helmet with a detachable chin guard, a jet helmet, or a convertible helmet with a chin guard that can be turned and fixed to the back of the helmet.

The exterior member 40 does not need to include the recess 45 in the attached surface 44. In other words, the attached surface 44 may be configured to be flat over the entire portion between the second outer surface 41 and the side surface 42. In this case, a hollow portion does not need to be formed between the exterior member 40 and the helmet body 10. The exterior member 40, which does not include the recess 45, has increased strength. Further, the attached surface 44 of the exterior member 40 may have a projection partially projecting toward the second attachment surface 10C. In this case, the second attachment surface 10C may include a recess to receive the projection of the attached surface 44. The exterior member 40 is positioned on the helmet body 10 through the engagement between the projection included in the attached surface 44 and the recess included in the second attachment surface 10C.

The thickness T2 of the second attachment surface 10C may be less than 0.8 times or greater than 2 times the thickness T1 of the first attachment surface 10B as long as the shape of the helmet body 10 allows for resin molding.

The third angle θ3 may be less than 90 degrees or greater than 270 degrees as long as the shape of the helmet body 10 satisfies the impact resistance requirements. Further, when the second attachment surface 10C includes the fixing recess 15, the third angle θ3 at part of the second boundary 14 may be less than the first angle θ1.

The second angle θ2 may be less than 90 degrees or greater than or equal to 180 degrees as long as the shape of the helmet body 10 satisfies the impact resistance requirements.

The two exterior members 40 do not need to be shaped to be plane-symmetrical to each other. Instead, one of the exterior members 40 may have a unique shape.

The second attachment surface 10C may include multiple surfaces. For example, the second attachment surface 10C may include a first surface on which the exterior member 40 is arranged and a second surface that has an inclination differing from that of the first surface and connects the first surface to the first outer surface 10A. In this case, the second face and the first outer surface 10A form the second angle θ2.

The exterior member 40 does not have to be located at need to be the rear side of the closing member as long as the exterior member 40 is arranged adjacent to the closing member, such as the chin guard 20 or the shield 30. For example, the exterior member 40 may be located above or below the closing member. Thus, the second attachment surface 10C of the helmet body 10 does not need to be located at the rear side of the first attachment surface 10B as long as it is located between the first attachment surface 10B and the first outer surface 10A. For example, the second attachment surface 10C may be located above or below the first attachment surface 10B.

The invention claimed is:

1. A helmet, comprising:

a helmet body including a front opening;

a closing member attached to an outer side of the helmet body to close the front opening; and an exterior member attached to the outer side of the helmet body adjacent to the closing member, wherein the helmet body includes a first outer surface having a curved shape, a first attachment surface to which the closing member is attached, and a second attachment surface, located between the first outer surface and the first attachment surface, to which the exterior member is attached, the exterior member includes a second outer surface having a curved shape continuous with the first outer surface having the curved shape, and a side surface extending from one end of the second outer surface toward the helmet body, the second outer surface and the side surface are formed at a first angle at a side located toward an inner side of the helmet body, the first outer surface and the second attachment surface are formed at a second angle where a boundary of the first outer surface and the second attachment surface extends at a side located toward the inner side of the helmet body, and the second angle is greater than the first angle.

2. The helmet according to claim 1, wherein the second angle is greater than or equal to 90 degrees and less than 180 degrees.

3. The helmet according to claim 1- or 2, wherein the first attachment surface and the second attachment surface are formed at a third angle where a boundary of the first attachment surface and the second attachment surface extends at a side located toward the inner side of the helmet, and the third angle is greater than the first angle.

4. The helmet according to claim 3, wherein the third angle is in a range of 90 degrees to 270 degrees.

5. The helmet according to claim 1, wherein the helmet body has a thickness in a normal direction at a part defining the second attachment surface that is 0.8 times to 2 times a thickness in a normal direction at a part defining the first attachment surface.

6. The helmet according to claim 1, wherein the exterior member includes an attached surface that connects the second outer surface to the side surface and faces the second attachment surface, and the attached surface includes a recess that does not contact the second attachment surface.

7. The helmet according to claim 1, wherein the helmet body further includes a bottom opening, open downward, through which a head of a wearer is fitted, the front opening is connected to the bottom opening at a front lower side of the helmet body, and the closing member includes a shield that closes an upper portion of the front opening and is light-transmissive, and a chin guard that closes a lower portion of the front opening and is separate from the helmet body.

* * * * *